US006698591B2

(12) United States Patent
Casses et al.

(10) Patent No.: US 6,698,591 B2
(45) Date of Patent: Mar. 2, 2004

(54) CONNECTOR MODULES DESIGNED TO BE POSITIONED ON BELTS

(75) Inventors: Claude Casses, Clevilliers (FR); David Jeandet, Epernon (FR); Alban Godefroy, Epernon (FR)

(73) Assignee: FCI, Paris (FR)

( * ) Notice: Subject to any disclaimer, the term of this patent is extended or adjusted under 35 U.S.C. 154(b) by 100 days.

(21) Appl. No.: 10/054,634

(22) Filed: Jan. 22, 2002

(65) Prior Publication Data

US 2002/0112985 A1 Aug. 22, 2002

(30) Foreign Application Priority Data

Jan. 23, 2001 (FR) ..... 01 01179

(51) Int. Cl.[7] ..... B65D 85/90
(52) U.S. Cl. ..... 206/716; 206/713
(58) Field of Search ..... 29/861; 206/701, 206/713–717; 439/527, 528, 540.1, 544–549, 553, 557, 884, 885, 891

(56) References Cited

U.S. PATENT DOCUMENTS

| | | | | |
|---|---|---|---|---|
| 4,118,859 A | * | 10/1978 | Busler | 206/716 |
| 4,360,969 A | | 11/1982 | Collier | 29/881 |
| 4,583,640 A | * | 4/1986 | Gillam | 206/716 |
| 4,621,486 A | * | 11/1986 | Slavicek | 206/713 |
| 4,631,897 A | * | 12/1986 | Slavicek | 206/713 |
| 4,875,582 A | * | 10/1989 | Finney et al. | 206/717 |
| 5,119,934 A | | 6/1992 | Karasawa et al. | 206/330 |
| 5,954,539 A | | 9/1999 | Hornung | 439/590 |

FOREIGN PATENT DOCUMENTS

| | | |
|---|---|---|
| EP | 0460634 A2 | 12/1991 |
| FR | 2580869 | 10/1986 |

* cited by examiner

*Primary Examiner*—Jim Foster
(74) *Attorney, Agent, or Firm*—Perman & Green, LLP

(57) ABSTRACT

A connector module designed to be positioned on a carrying belt is disclosed. The module includes pins 30 for engaging in holes made on the carrying belt. The module and carrying belt assembly is designed to be used in a machine for automatically wiring connectors into bundles of cables and notably cables of the flexible circuit type.

9 Claims, 4 Drawing Sheets

CONNECTOR MODULES DESIGNED TO BE POSITIONED ON BELTS

BACKGROUND OF THE INVENTION

1. Field of the Invention

The invention described herein relates to the creation of connector modules adapted to be positioned on a carrier belt and, the resulting belt of connector modules.

The invention can be utilized particularly within the scope of a device and a station for crimping contacts onto flexible circuits, a station designed for the assembly and creation of bundles of flexible circuits provided with connectors, the contacts and the flexible circuits being taken up in connector modules.

A complete automatic crimping station comprising a crimping post for the modules conforming to the invention can have an automated intake device for these connectors with their premounted contacts.

2. Description of Prior Development

In order to bring the connectors to a complete automatic crimping station, it is known to link the connector modules to one another, for example, as described in the document EP 0 460,634. This document provides the connector modules with tabs on the rear face of the connectors, these tabs being taken up in a system of slots at the front of the preceding connector module. This system remains rigid and is poorly adapted to coiling of the connectors.

Moreover, the creation of support coils for surface mounting is known, these coils being made of plastic belts provided with housings for the components.

SUMMARY OF THE INVENTION

The invention proposes creating connector modules designed to be positioned on a carrier belt. For this purpose, the connector modules engage onto a carrier belt and for their engagement principally have clipping pins furnished with catches that hook into holes in the carrier belt.

These clipping pins can be arranged on the tabs extending from the body of the module in a direction parallel to the carrier belt, the tabs possibly able to contain breakaway zones that can be cut so as to disconnect the modules from the belt at the level of an intake post for the connectors or to cut them after removal of the modules from the belt.

Connector modules according to the invention can be provided in rolls or coils, since a device for feeding into a station for crimping, cabling or insertion of the electrical contacts thus has a post for continuous unrolling and, after the unrolling post, there is a device for disconnecting the connectors from the carrier belt and a device for intake of the connector units.

BRIEF DESCRIPTION OF THE DRAWING

Advantageously for connector modules of the type provided with a slot for access to the crimping zone and also provided with a shutter for holding the flexible circuit, the shutter can have a framework connected by a hinge to the connector casing taking up the contacts, the carrier belt can be provided with flaps inserted between the shutter and the rear part of the module making up the crimping slot, and the modules may be pre-equipped or not with their contacts.

In one particularly advantageous mode of embodiment of the invention, the catches as well as the holes in the belt receiving them may have a rectangular profile, whose long axis is parallel to the belt and to the axis of the contacts in the connector.

Such an arrangement of the catches flattens the connector onto the belt and permits making only two attachment points for the connector onto the belt, advantageously at the end of the arm positioned at the rear of the connector provided in the crimping zone on the flexible circuit, the connector being positioned on the belt so as to be pulled by the catches during progression of the belt and to present its rear part in front of the progression.

An additional advantage endowed by the rectangular profile of the pins is keeping the connector aligned on the belt in the case where one of the arms bearing the catches breaks, the rectangular profile preventing the connector from rotating around the remaining pin.

The flap, for its part, prevents an accidental closing of the shutters when the modules are provided there.

Figure 1:
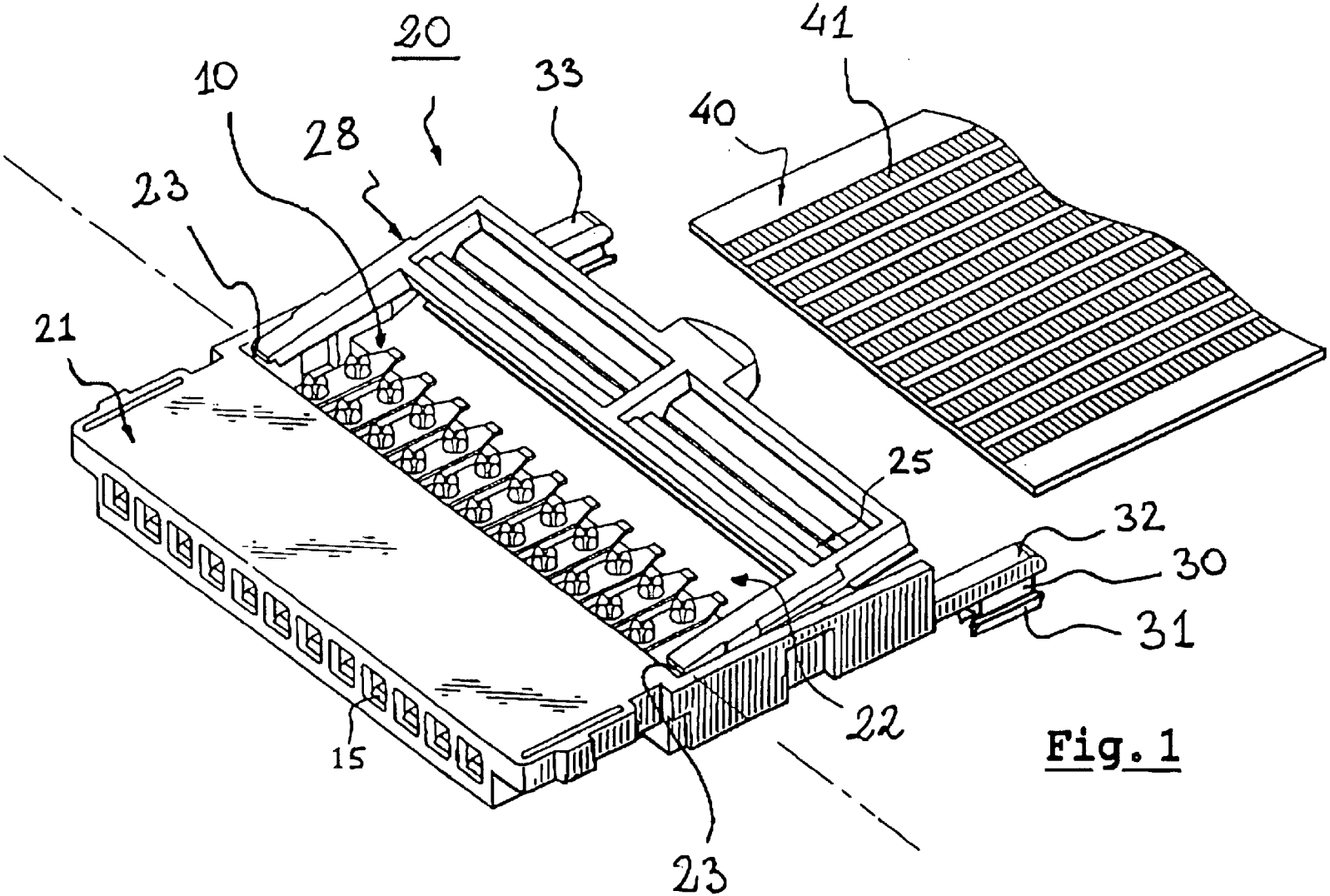
Figure 2A:
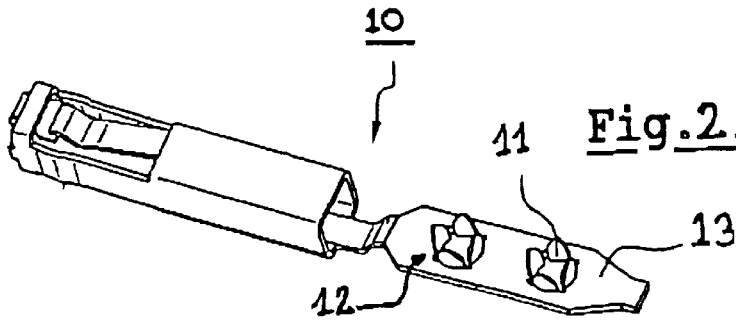
Figure 2B:
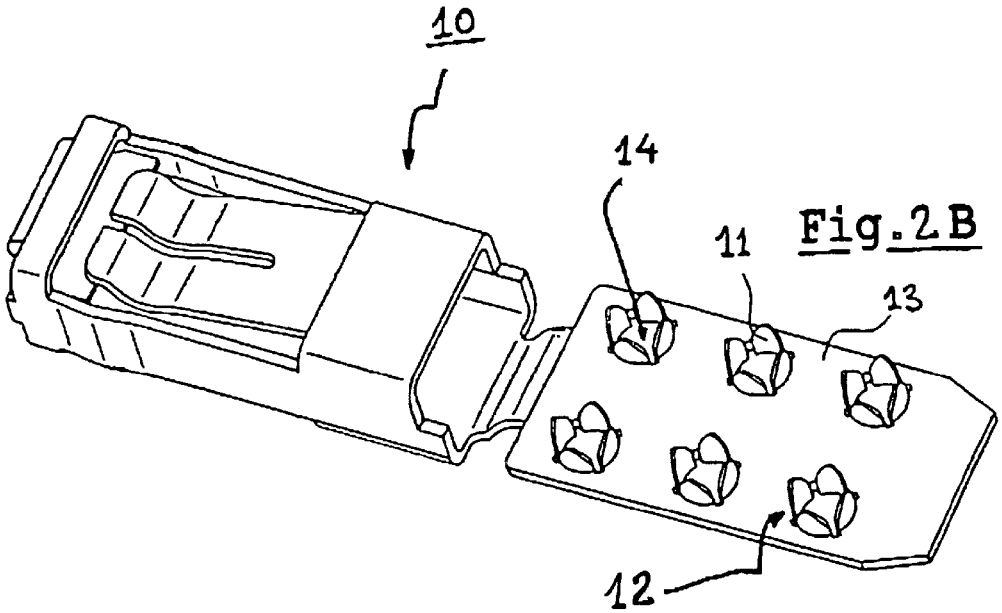
Figure 3A:
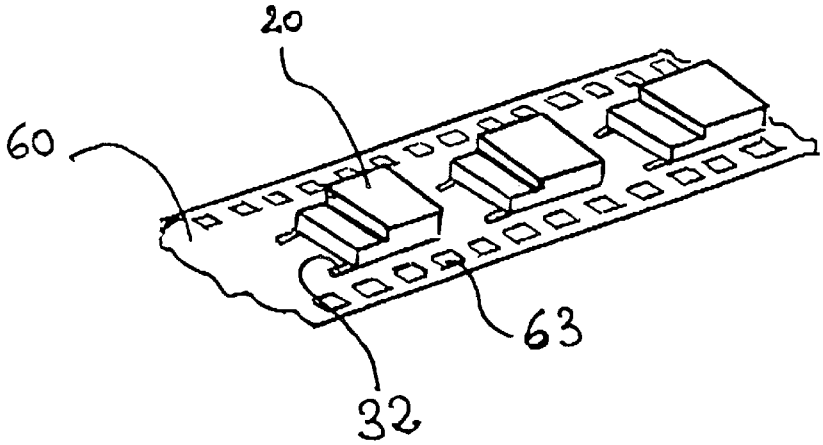
Figure 3B:
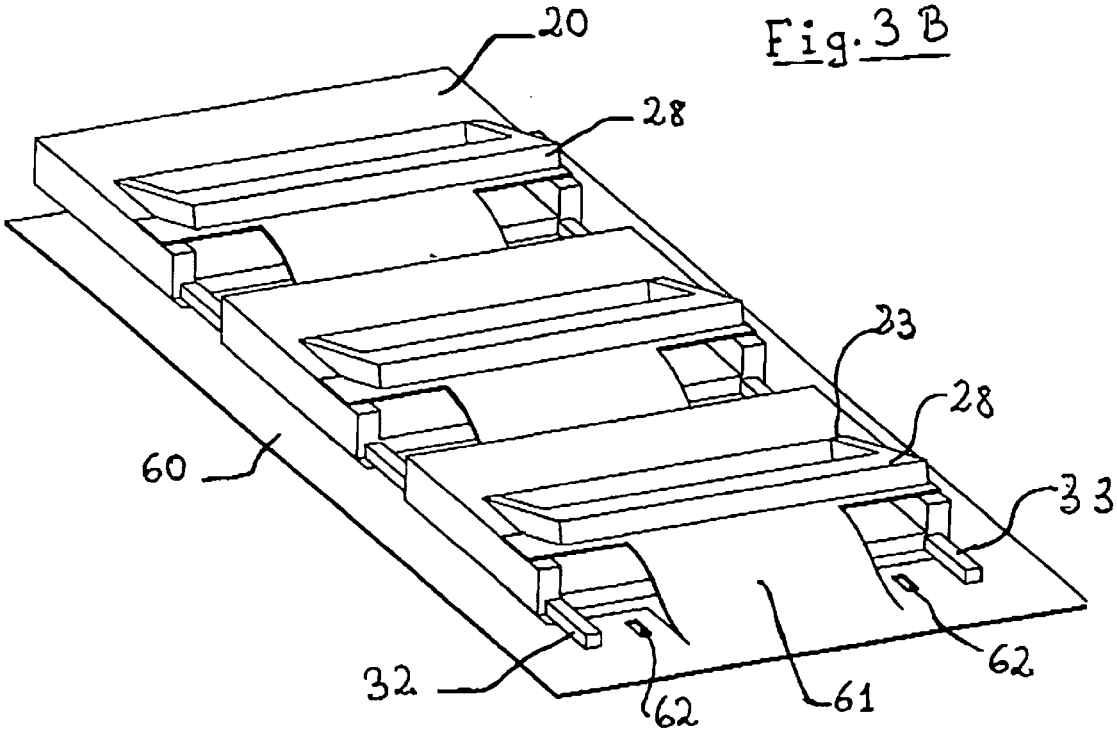
Figure 4:
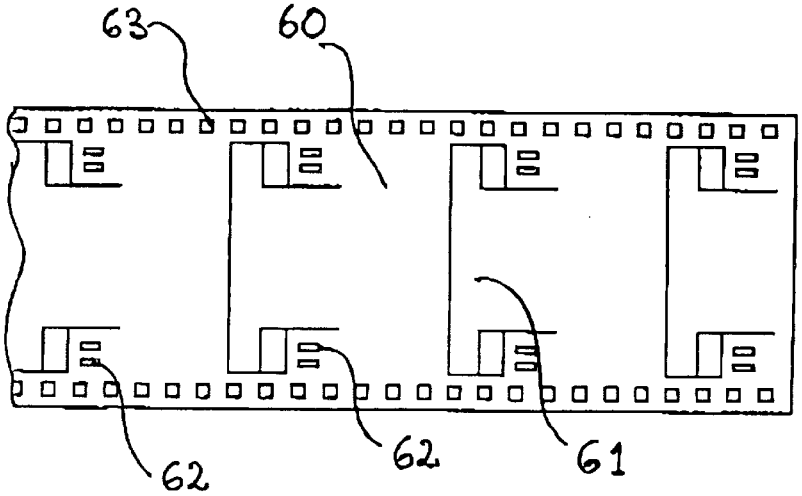
Figure 5:
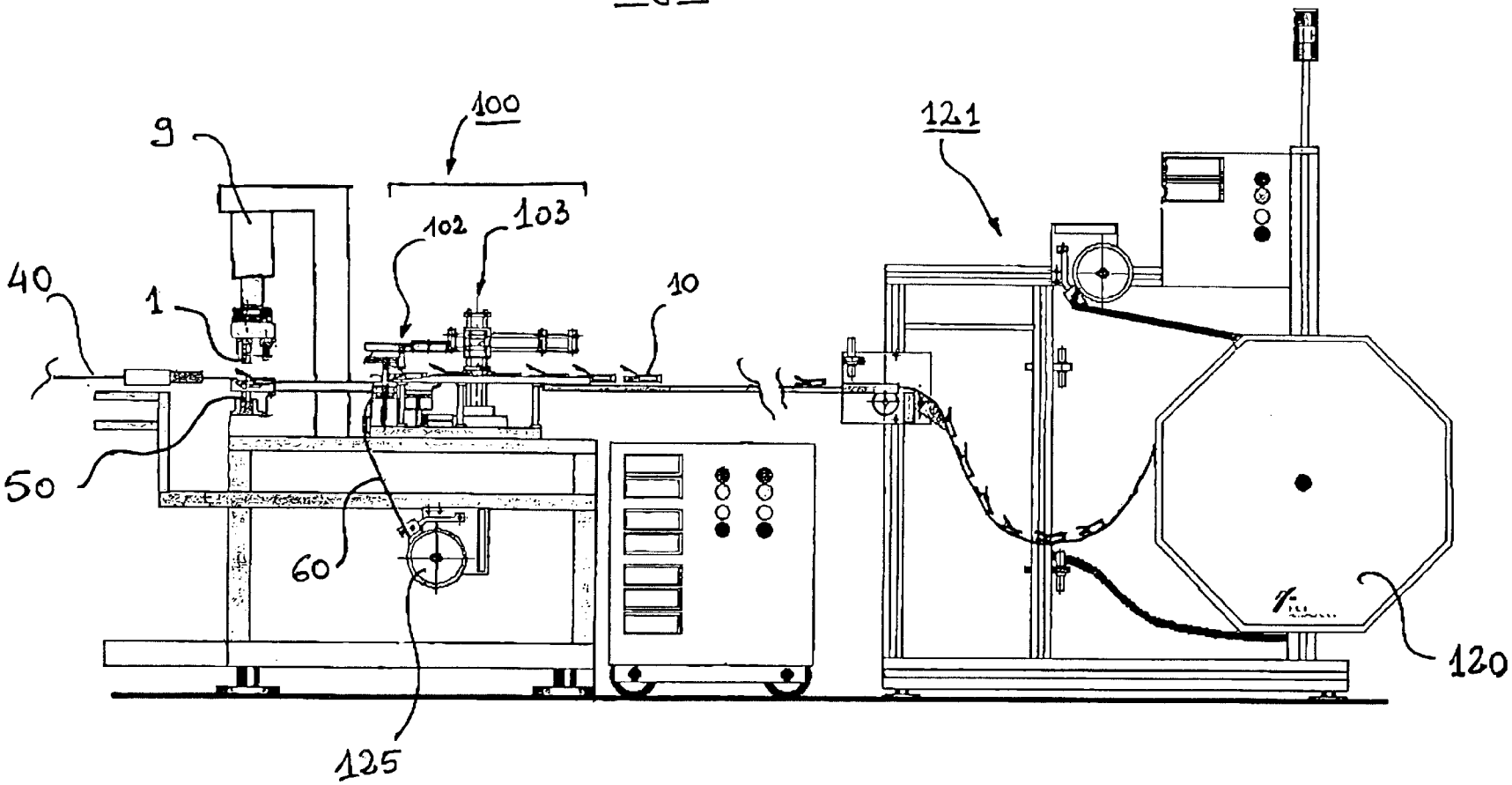

The invention will be better understood upon reading the description of one particular and non-limiting mode of embodiment of the invention in reference to the drawings which show:

FIG. 1 is a perspective view of one example of a connector having the elements of the invention;

FIGS. 2A and 2B are illustrations of examples of contacts provided with a crimping plate that can be used in a connector module according to the invention;

FIGS. 3A and 3B illustrate belt and connector modules according to the invention;

FIG. 4 illustrates an example of a transport belt for connector modules according to the invention; and FIG. 5 illustrates a schematic view of a part of the wiring station for the connectors according to the invention.

DESCRIPTION OF THE PREFERRED EMBODIMENTS

According to FIG. 5, a coupling device for the connector modules receiving electrical contacts and a flexible circuit based principally on the creation of a post for simultaneous crimping of contacts onto the flexible circuit, is described in a general way and as an example The contacts and the flexible circuits are taken up in the connector modules. The crimping post is based on a crimping tool having a multipoint network of crimping matrices made up of a solid block 1.

For contacts 10 as described in FIG. 2 and provided with crimping points 11 arranged in a crown 12, the matrix network comes into contact with the crimping points during the crimping operation under the action of a press so as to press back the points and shape them into petals.

This device is designed for crimping of a connector 20 described in FIG. 1 provided with a plurality of contacts 10. In this type of connector, the contacts have an end for coupling to a flexible circuit 40 on one side, this end having a paddle part 13 provided with points 11 arranged in a crown 12, the points being made by a cross punching of the paddle part and then pressing of the paddle part, bending the points and clearing away a circular hole 14 forming crown 12.

On the other side, the contacts have an end 15 for connection with a complementary contact, the contacts and the flexible circuit being taken up in the connector module comprised of an insulating casing 21 provided with an open zone 22 for access to the crimping zone for the contacts on the flexible circuit above and below the crimping zone.

In order to crimp the contacts, the device has, on the one hand, an anvil 50 forming a lower support surface for electrical contact elements 10, the crimping device having, on the other [upper] side, a mobile press device 9 provided with a block 1 whose surface parallel to the plane of alignment of the contacts has a plurality of crimping matrices.

Anvil 50 positioned under paddle parts 13 can have positioning elements arranged facing the crowns of both contacts positioned at each end of flexible circuit 40, each positioning element being introduced into circular hole of a crown. It is therefore necessary to keep the modules in a given alignment, immediately after their positioning on the belt to simplify their handling by the different tools of the crimping station.

Still during crimping, flexible circuit 40 is positioned on paddle parts 13 and the crimping matrices are applied by the press onto the flexible circuit, each of the matrices strongly and locally applying flexible circuit 40 onto points 11 so as to pierce the flexible circuit and tracks 41 and then to camber the points that thus come to crimp the paddle parts, onto the flexible circuit and to create the electrical connection between contacts 10 and conductive tracks 41 of the flexible circuit.

A complete automatic crimping station can have an automated intake device 100 for these connectors with their premounted contacts.

In order to introduce the connector modules, it is advantageous to position them on a carrying belt 60 such as shown in FIGS. 3A and 3B. For this purpose, the invention proposes engaging the connectors on the carrying belt in order to bring them by rollers 120 to the crimping station, a feed device for the crimping station thus having a continuous unrolling post 121 of the type known in and of itself.

Still referencing FIG. 5, the connectors positioned on their carrying belt 60, after the unrolling post, must be loaded into a device for detaching the connectors from the carrying belt and an intake device 100 for taking the connector units toward the crimping station. Carrying belt 60, which may still have tabs 32, 33 is then wound onto a coil 125.

The intake device is advantageously provided with a handling component for the modules positioned at the end of an arm 102, which is itself joined to a transport device 103.

According to FIG. 1, the connectors are provided with a slot 22 for access to the crimping zone and are also provided with a shutter 28 for holding the flexible circuit.

Shutter 28 has a frame connected by a hinge 23 to the casing of the connector receiving the contacts. This frame permits conducting the crimping operation through shutter 28, the shutter being shut again after the crimping operation, this shutter 28 having a rear arm 24 provided with one or more protruding pieces 25 for support and putting pressure on the flexible circuit to isolate and protect the crimping zone from possible stresses applied onto the flexible circuit beyond the connector.

During the positioning of the connector modules provided with shutters on the belt, it is necessary to prevent the shutters from closing. Also, as is visible in FIG. 3B, carrying belt 60 is provided with flaps 61 inserted between shutter 28 and the rear part of the module making up the crimping slot, the modules being pre-equipped with their contacts or not. These flaps are made by a cut-out in the carrying belt during its manufacture. In addition to these cut-outs, the carrying belt has holes 62 for taking up the clipping catches for the modules as well as holes 63 for engaging, which permit advancing the carrying belt provided with the modules.

Means for holding the connector modules on the carrying belt are shown in FIG. 1. These means are made up of clipping pins 30 provided with catches 31 hooking into holes 62 of the carrying belt shown in FIG. 4. In the case where it is necessary to limit the height of the modules, the pins are positioned on tabs 32 projecting beyond the body of the module in a direction parallel to the carrying belt, and the tabs may be cut so as to detach the modules from the belt at the level of the connector intake post, the tabs thus remaining on the belt and not risking becoming wedged in the modules.

Of course, it is also possible to cut the tabs after detachment of the modules from the belt or to leave them in place.

By reference to FIGS. 1 and 4, it can be seen that catches 31 as well as holes 62 of the belt receiving them advantageously have a rectangular profile whose large axis is parallel to the belt and to the axis of the contacts in the connector.

Such a structure of the catches flattens the connector onto the belt and permits making only two attachment points for the connector onto the belt, for example, at the end of tabs 32, 33 which are positioned on the rear part of the connector, the part provided with the zone for crimping onto the flexible circuit, and the connector being positioned on the belt so as to be pulled by the catches during progression of the belt and to present its rear part at the front of the progression.

An additional advantage given by the rectangular profile of the pins is to keep the connector aligned on the belt in the case where one of the tabs bearing the catches becomes broken, the rectangular profile preventing the connector from rotating around the remaining pin.

What is claimed is:

1. A connector module adapted to be positioned on a carrying belt, wherein the module includes a casing having a surface riding on the carrying belt, wherein the module further includes tabs coupled to the casing, the tabs having clipping pins for engaging the module onto the carrying belt, the pins being provided with catches that hook into holes positioned on the carrying belt.

2. A module according to claim 1, wherein said tabs are projecting beyond said casing in a direction substantially parallel to a length of said carrying belt.

3. A module according to claim 2, wherein said tabs bear cutting zones permitting cutting the tabs so as to detach said module from said belt.

4. A module according to claim 1, wherein said catches as well as said holes in said belt receiving said catches include a rectangular profile whose large axis is parallel to a length of said belt and to an axis of contacts taken up in said connector.

5. A module according to claim 1, wherein said module includes a shutter for holding a flexible circuit.

6. A module according to claim 5, wherein said shutter has a frame connected by a hinge to the body of said module.

7. A connector module adapted to be positioned on a carrying belt, wherein the module includes clipping pins for engaging the module onto the carrying belt, the pins being provided with catches that hook into holes positioned on the carrying belt, wherein said catches as well as said holes in said belt receiving said catches include a rectangular profile whose large axis is parallel to said belt and to an axis of contacts taken up in said connector, wherein said module includes two of said catches for attachment of said connector onto said belt, at the end of tabs positioned at the rear of said connector, said connector being positioned on said belt so as to be pulled by said catches during progression of said belt and to present its rear part at the front of the progression.

8. A connector module according to claim 1, wherein the casing is adapted for holding contacts crimped to a flat flexible conductor.

9. A device for positioning a connector module on a carrying belt, wherein the module includes clipping pins for engaging the module onto the carrying belt, the pins being provided with catches that hook into holes positioned on the carrying belt, wherein said module includes a shutter for holding a flexible circuit, wherein said shutter has a frame connected by a hinge to the body of said module, and wherein said module includes said carrying belt provided with flaps inserted between said shutter and a rear part of said module.

* * * * *